US006981899B1

(12) United States Patent
Miller et al.

(10) Patent No.: US 6,981,899 B1
(45) Date of Patent: Jan. 3, 2006

(54) ELECTRICAL CONNECTOR ASSEMBLY WITH NON-ORTHOGONAL JACK STOP SURFACE FOR ENGAGING PLUG LATCH ABUTMENT

(75) Inventors: Alan C. Miller, Madison, CT (US); Randolph R. Ruetsch, Branchburg, NJ (US); Shadi A. Abughazaleh, Gales Ferry, CT (US); Nathaniel L. Herring, Norwich, CT (US); John J. Milner, Madison, CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 10/899,306

(22) Filed: Jul. 27, 2004

(51) Int. Cl.
*H01R 24/00* (2006.01)

(52) U.S. Cl. ..... 439/676; 439/941

(58) Field of Classification Search ..... 439/676, 439/941, 677, 345, 438, 669
See application file for complete search history.

(56) References Cited

U.S. PATENT DOCUMENTS

| | | | | |
|---|---|---|---|---|
| 4,698,025 | A * | 10/1987 | Silbernagel et al. | 439/79 |
| 5,399,107 | A | 3/1995 | Gentry | |
| 5,772,466 | A | 6/1998 | Morin | |
| 6,031,909 | A * | 2/2000 | Daoud | 379/438 |
| 6,296,528 | B1 * | 10/2001 | Roberts et al. | 439/676 |
| 6,364,694 | B1 | 4/2002 | Lien | |
| 6,419,527 | B2 | 7/2002 | Reichle | |
| 6,540,543 | B1 | 4/2003 | Watanabe | |
| 6,663,436 | B1 * | 12/2003 | Arnett et al. | 439/676 |
| 6,848,949 | B2 * | 2/2005 | Mullaney et al. | 439/676 |

FOREIGN PATENT DOCUMENTS

EP 0 251 518 A2 1/1988

* cited by examiner

*Primary Examiner*—Chandrika Prasad
(74) *Attorney, Agent, or Firm*—Mark S. Bicks; Alfred N. Goodman

(57) ABSTRACT

An electrical connector assembly includes a jack and a plug. The jack has a cavity for receiving the plug, a stop member and latch stop. The plug has a plug body and a resilient latch arm with an arm and an abutment. The latch stop is spaced from the stop member by a jack nominal dimension within a jack tolerance. The plug has a free end spaced from the arm abutment by a plug nominal dimension within a plug tolerance. The difference between the jack nominal dimension and the plug nominal dimension is not greater than the sum of the jack tolerance and the plug tolerance.

10 Claims, 2 Drawing Sheets

ELECTRICAL CONNECTOR ASSEMBLY WITH NON-ORTHOGONAL JACK STOP SURFACE FOR ENGAGING PLUG LATCH ABUTMENT

FIELD OF THE INVENTION

The present invention relates to an electrical connector assembly formed of a jack and a plug, particularly for telecommunications and data transmission systems. The jack has a cavity for receiving the plug and holds the plug between a stop member and a latch stop, with the plug free end surface engaging the stop member and an abutment surface on a resilient latch arm of the plug engaging the latch stop. The latch stop has a non-orthogonal stop surface.

BACKGROUND OF THE INVENTION

Electrical connectors formed of a jack and a plug for telecommunications and data transmission systems are disclosed in U.S. Pat. No. 4,648,678 to Archer, U.S. Pat. No. 5,061,219 to Bolick and U.S. Pat. No. 5,399,107 to Gentry. Such connectors have limited performance capabilities, particularly for high performance data transmission at high frequencies. Performance characteristics, particularly near end crosstalk, degrade at these higher frequencies.

SUMMARY OF THE INVENTION

An object of the present invention is to provide an electrical connector, particularly for telecommunications and data transmission systems with enhanced performance characteristics.

The foregoing object is basically obtained by an electrical connector assembly comprising a jack and a plug. The jack has a housing with a plug receiving cavity and a plurality of electrical jack contacts extending into the cavity. The cavity has a plug insertion axis. A stop member is provided in the housing and has an inner end surface facing and defining an inner end of the cavity. A latch stop is on the housing at an entrance to the cavity, and has a latch surface facing the cavity and extending in a plane acutely angled relative to the plug insertion axis. The stop surface has an outer edge and an inner edge, with the outer edge being closer to the inner end surface and farther from the plug insertion axis than the inner edge. The inner end surface and the outer edge are spaced by a jack nominal dimension along a line parallel to the plug insertion axis within a jack tolerance. The plug has a plug body with a plurality of plug contacts and has a free end surface engagable with the jack contacts and with the inner end surface, respectively, when the plug body is received in the cavity. A resilient latch arm extends from the plug body and has an arm abutment with an abutment surface engagable with the stop surface when the plug is fully inserted in the cavity. The abutment surface and the free end surface are spaced by a plug nominal dimension within a plug tolerance. The difference between the jack distance and the plug distance is not greater than a sum of the jack tolerance and the plug tolerance.

By forming the electrical connector assembly in this manner, the play or float of the plug within the jack is limited. By limiting this float or play, the jack contacts and the plug contacts will engage more closely at the same points, as intended and designed. The failure of conventional electrical connector assemblies to repeatedly and accurately have their contacts engage at the same points causes the electrical properties to change, resulting in a degrading of the electrical performance characteristics from the ultimate design characteristics.

The limitation of the tolerance is relative to the difference as compensated by the non-orthogonal or autely angled orientation of the stop surface in combination with the relationships of the jack and plug nominal dimensions and jack and plug tolerances.

In conventional systems, too much play is provided by the tolerances and the relationship of the nominal plug dimension and the nominal jack dimension. These dimensions are concerned with providing, in all cases, an adequate minimum space such that the spacing between the plug free end surface and the plug abutment surface is always less than the distance between the housing inner end surface and the housing stop surface, even at the maximum size of the plug distance and the minimum size of the jack distance. As the conventional electrical connector assembly approaches the opposite extremes of the tolerances, further play is provided between the plug and the jack which degrades the electrical performance characteristics. By failing to maintain the designed point contact of the respective contacts, the electrical performance of the electrical connector assembly in adversely affected.

As used in this application, the phrase, within a tolerance means, plus or minus a tolerance dimension relative to the nominal dimension of the design. In other words, "within" is intended to mean "plus or minus".

Other objects, advantages and salient features of the present invention will become apparent from the following detailed description, which taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
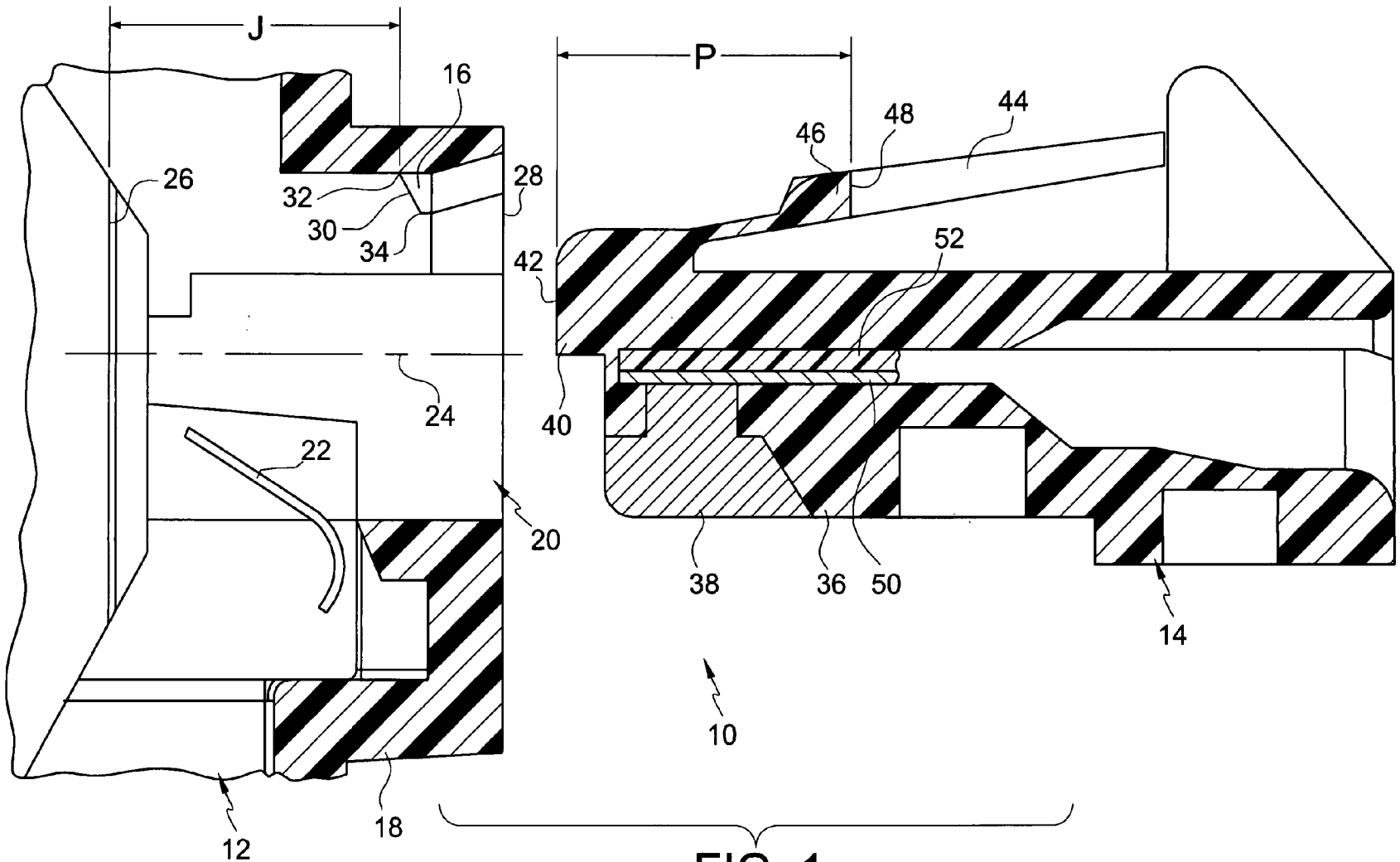
FIG. 1 is a side elevational view in section of an electrical connector assembly with the jack and plug separated.
Figure 2:
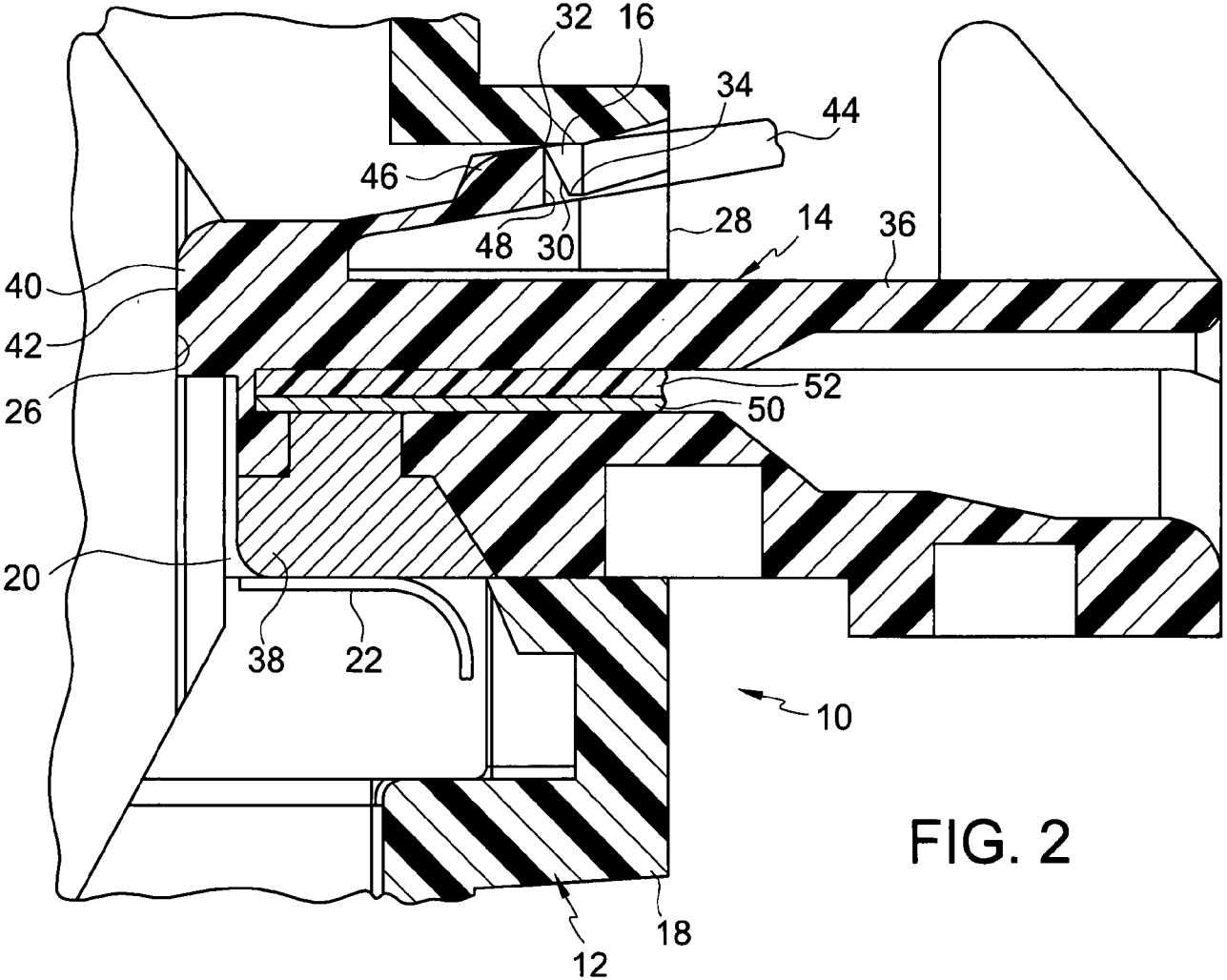
FIG. 2 is a side elevational view in section of the electrical connector assembly of FIG. 1 with the jack and plug connected.

An electrical connector assembly 10 according to the present invention includes a jack 12 and a plug 14. Both the jack and the plug are of conventional design, except for the configuration of the housing latch stop 16 and certain dimensions of the plug and housing. These dimensions and configuration of the latch stop according to the present invention provide a more precise connection, thereby enhancing electrical performance of the electrical connector assembly.

Jack 12 includes a housing 18 of plastic insulating material having a plug receiving cavity 20. A plurality of electrical jack contacts 22, usually eight in number, are mounted in the housing and extend in a cantilever manner into cavity 20. Plug receiving cavity 20 has or defines a plug insertion axis 24. The inner end of cavity 20 is defined by a substantial planar inner end surface 26 that is substantially perpendicular to plug insertion axis 24. Such surface can be continuous or interrupted, and is of a substantially conventional configuration.

Latch stop 16 is provided on the housing adjacent entrance 28 to cavity 20. The latch stop has a substantially planar stop surface 30 facing into cavity 20 and extending in a plane acutely angled or non perpendicular to plug insertion axis 24. Although surface 30 is substantially planar, it is usually interrupted with portions on each lateral side of the cavity. The stop surface has an outer edge 32 and an inner edge 34, when viewed in a radial direction relative to insertion axis 24. Outer edge 32 is closer to inner end surface 26 and farther from plug insertion axis 24 than inner edge 34.

Inner end surface 26 and outer edge 32 are spaced by a jack nominal dimension J along a line parallel to the plug insertion axis. The jack nominal dimension is within or plus/minus a jack tolerance. The jack dimension is preferably substantially 0.232 inch, and is more preferably essentially 0.232 inch. The jack tolerance is preferably substantially plus/minus 0.002 inch, and is more preferably essentially plus or minus 0.002 inch.

Plug 14 has a plug body 36 supporting a plurality of electrically conductive plug contacts 38 adjacent a free end 40 of plug 14. The plug free end defines a free end surface 42. When the plug is insert into cavity 20, the respective plug contacts 38 engage and form an electrical connection with the respective jack contacts 22. Additionally, when the plug is fully inserted, free end surface 42 engages housing inner end surface 26 to limited the amount of plug insertion into cavity 20.

A resilient latch on extends rearwardly and radially outwardly from free end 40 of plug body 36. The latch on has an arm abutment 46 with a substantially planar abutment surface 48 that is substantially perendicular to plug insertion axis 24 and the longitudinal axis of plug body 36. Abutment surface 48 is engageable with stop surface 30 when plug 14 is fully received within housing cavity 20.

The abutment surface and free end surface are spaced by a plug nominal dimension P. The plug nominal dimension is within or plus/mius a plug tolerance. The plug nominal dimension is preferably substantially 0.230 inch, and is more preferably essentially 0.230 inch. The plug tolerance is preferably substantially plus or minus 0.003 inch, and more preferably essentially plus or minus 0.003 inch.

The difference between the jack distance and plug distance is not greater than the sum of the absolute value of the jack tolerance and the absolute value of the plug tolerance. Preferably, the distance is less than the sum, and more preferably is substantially less than the sum.

With the jack nominal dimension being 0.232 inch and the plug nomonal dimension being 0.230 inch, the difference between those two nominal dimensions is 0.002 inch. With the jack tolerance being plus or minus 0.002 inch and the plug tolerance being plus or minus 0.003 inch, the sum of the absolute values of the jack tolerance and plug tolerance is 0.005 inch, which sum is greater than the nominal dimensional difference of 0.002 inch. The jack dimension, with the plug tolerance, can thus be between 0.230 inch to 0.234 inch. The plug dimension with the tolerance can than be between 0.0227 inch and 0.233 inch. In this manner, the plug plug nominal dimension with the plug tolerance can be greater than the jack dimension with its tolerance. In such circumstances, abutment surface can ride up or be positioned in a suitable location on stop surface 30 between outer edge 32 and inner edge 34, and still provide a suitable latching force by the engagement of abutment surface 38 on stop surface 30 when the plug is fully inserted within cavity 20.

The angle of the planar stop surface 30 relative to plug insertion axis 24 is preferably between about 27 and 29 degrees. Such angle provides adequate flexibility, while maintaining a positive latching of the plug in the receptacle.

By setting the plug and jack nominal dimensions and the plug and jack tolerances in this manner, the plug is more precisely fit within cavity 20. By more precisely fitting the plug within the cavity, the plug contacts 38 engage the jack contents 22 more precisely relative to the designed contact position. With this more precise engagement of the contacts, the electrical characteristics of the connector assembly are enhanced in that the engagement of the contacts is more closely in alignment with the design criteria to maximize electrical performance, for example, by minimizing crosstalk. When the plug can freely slide axially within the cavity, due to the distance between the housing inner end surface and stop surface being substantially greater than the distance between the plug abutment surface and free end surface, to change the engagement position of the plug contacts and the jack contacts, electrical performance of the electrical connector assembly will degrade as the engagement of the contacts moves from their optimum design positions.

In use, plug contacts 38 are connected conductors 50 of twisted wire pairs which are mounted within a wire support 52 and extend from the plug end opposite free end 40. The arrangements of the twisted wire paths and the wire support are conventional, and thus, not described herein in detailed. In a similar manner the contacts 22 are similarly connected to respective wiring.

While one embodiment has been chosen to illustrate the invention, it would be understood by those skilled in the art that various changes and modifications can be made therein without departing from the scope of the invention as defined in the appended claims.

What is claimed is:

1. An electrical connector assembly, comprising:

a jack having a housing with a plug receiving cavity and a plurality of electrical jack contacts extending into said cavity, said cavity having a plug insertion axis;

a stop member in said housing having an inner end surface facing and defining an inner end of said cavity;

a latch stop on said housing at an entrance to said cavity, said latch stop having a stop surface facing said cavity and extending in a plane acutely angled relative to said plug insertion axis, said stop surface having outer edge and an inner edge with said outer edge being closer to said inner end surface and farther from said plug insertion axis than said inner edge, said inner end surface and said outer edge being spaced by a jack nominal dimension along a line parallel to said plug insertion axis within a jack tolerance;

a plug having a plug body with a plurality of plug contacts and having a free end surface engagable with said jack contacts and with inner end surface, respectively, when said plug body is received in said cavity;

a resilient latch arm extending from said plug body and having an arm abutment with an abutment surface engagable with said stop surface when said plug is fully received in said cavity, said abutment surface and said free end surface being spaced by a plug nominal dimension within a plug tolerance; and a difference between said jack nominal dimension and said plug nominal dimension not being greater than a sum of an absolute value of said jack tolerance and an absolute value of said plug tolerance.

2. An electrical connector assembly according to claim 1 wherein said inner end surface is substantially perpendicular to said plug insertion axis.

3. An electrical connector assembly according to claim 2 wherein said abutment surface is substantially perpendicular to a longitudinal axis of said plug body.

4. An electrical connector assembly according to claim 1 wherein said abutment surface is substantially perpendicular to a longitudinal axis of said plug body.

5. An electrical connector assembly according to claim 1 wherein said difference is less than said sum.

6. An electrical connector assembly according to claim 1 wherein said difference is substantially less than said sum.

7. An electrical connector assembly according to claim 1 wherein said jack dimension is substantially 0.232 inch;

said jack tolerance is substantially 0.002 inch;

said plug dimension is substantially 0.230 inch; and said plug tolerance is substantially 0.003 inch.

8. An electrical connector assembly according to claim 1 wherein said jack dimension is essentially 0.232 inch, said jack tolerance is essentially 0.002 inch;

said plug dimension is essentially 0.230 inch; and said plug tolerance is essentially 0.003 inch.

9. An electrical connector assembly according to claim 1 wherein said plug dimension with said plug tolerance can be greater than said jack dimension with said plug tolerance.

10. An electrical connector assembly according to claim 1 wherein said free end surface and said abutment surface are spaced along a longitudinal axis of said plug body by a plug distance; and said inner end surface and said outer edge of said jack are spaced along said plug insertion axis by a jack distance which is greater than said plug distance such that said abutment surface is between said inner edge and said outer edge when said plug is fully inserted in said cavity.

* * * * *